US008568952B2

(12) United States Patent
Vong et al.

(10) Patent No.: US 8,568,952 B2
(45) Date of Patent: Oct. 29, 2013

(54) METHOD FOR MANUFACTURING PHOTORECEPTOR LAYERS

(75) Inventors: Cuong Vong, Hamilton (CA); Marko Saban, Toronto (CA); Vladislav Skorokhod, Concord (CA); Lanhui Zhang, Webster, NY (US); Lin Ma, Pittsford, NY (US); Norman Chi Su, Berkeley, CA (US); Zhen Lai, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 56 days.

(21) Appl. No.: 13/358,157

(22) Filed: Jan. 25, 2012

(65) Prior Publication Data

US 2013/0189616 A1 Jul. 25, 2013

(51) Int. Cl.
*G03G 5/047* (2006.01)

(52) U.S. Cl.
USPC ..... 430/135; 430/127; 430/133

(58) Field of Classification Search
USPC ..... 430/135, 127, 133
See application file for complete search history.

(56) References Cited

U.S. PATENT DOCUMENTS

| | | | | |
|---|---|---|---|---|
| 3,121,006 | A | 2/1964 | Middleton et al. | |
| 4,464,450 | A | 8/1984 | Teuscher | |
| 4,587,189 | A | 5/1986 | Hor et al. | |
| 4,921,773 | A | 5/1990 | Melnyk et al. | |
| 5,069,993 | A | 12/1991 | Robinette et al. | |
| 7,188,993 | B1 | 3/2007 | Howe et al. | |
| 7,695,817 | B2 | 4/2010 | Lin et al. | |
| 7,816,415 | B2 | 10/2010 | Quapp et al. | |
| 7,866,878 | B2 | 1/2011 | Howe et al. | |
| 2009/0297972 | A1 * | 12/2009 | Sakimura et al. | 430/66 |
| 2010/0266948 | A1 | 10/2010 | Lai et al. | |
| 2010/0266949 | A1 | 10/2010 | Lai et al. | |

* cited by examiner

*Primary Examiner* — Hoa V Le
(74) *Attorney, Agent, or Firm* — Hoffman Warnick LLC

(57) ABSTRACT

The present teachings describe a process for mixing comprising obtaining a dispersion of solid particles and an organic solvent wherein the dispersion comprises a particulate solid content of from about 0.5 weight percent to about 10 weight percent. The dispersion is mixed at a resonant frequency of the mixing system.

20 Claims, 3 Drawing Sheets

METHOD FOR MANUFACTURING PHOTORECEPTOR LAYERS

BACKGROUND

1. Field of Use

The present disclosure relates to processes for producing charge transport layers and charge generation layers for use in photoreceptors.

2. Background

This disclosure relates generally to charge generation layers and the charge transport layers and a method for efficient manufacturing of such layers.

One method for dispersion processing utilizes a high shear cavitation technique. Typically, the mixture of all components undergoes multiple passes through a nozzle under high pressure. High shear causes the formation of cavitation bubbles. The collapse of cavitation bubbles is accompanied by shock waves, vigorous shearing forces, and a release of significant amounts of energy, which dissipates into the surrounding fluid. Each cavitation bubble uses the energy released upon implosion of the bubble to transfer energy to the dispersion. The severe conditions of a high shear process produce less stable and less uniform dispersions. The particles in the resulting dispersions tend to aggregate.

Roll mills and paint shakers are used for dispersion processing. Roll mill milling time can be as long as several days. Additionally, both paint shaker and roll mill milling processes are difficult to control and depend on a number of process parameters such as vessel volume and configuration, media type, size and loading etc.

There is a need to introduce a more efficient dispersion mixing process with few control parameters (thus, more robust with much less potential for errors) and significantly shorter mixing times. A reliable and less time intensive mixing process which produces uniform dispersions is desired.

SUMMARY

According to an embodiment, there is provided a process for mixing comprising obtaining a dispersion of solid particles and an organic solvent wherein the dispersion comprises a particulate solid content of from about 1 weight percent to about 10 weight percent. The dispersion is mixed on a mixer that applies high intensity acoustic energy at a resonant frequency of the mixing system.

According to another embodiment, there is provided a process of forming a charge generation layer. The process comprises mixing a dispersion of solid pigment particles, a binder and an organic solvent wherein the dispersion comprises a particulate solid content of from about 1 weight percent to about 10 weight percent. The dispersion is subjected to acoustic mixing at a resonant frequency of the mixing system. The dispersion is coated on a conductive substrate and the solvent is removed to form a charge generation layer.

According to another embodiment there is disclosed a process of forming a charge transport layer. The process comprises mixing a dispersion of polytetrafluoroethylene, a binder and an organic solvent wherein the dispersion comprises a particulate solid content of from about 1 weight percent to about 10 weight percent. The dispersion is subjected to acoustic mixing at a resonant frequency of the mixing system to produce a relative scattering index of less than about 0.1 in the dispersion. The dispersion is coated on a conductive substrate and the solvent is removed to form a charge transport layer.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

It should be noted that some details of the figures have been simplified and are drawn to facilitate understanding of the embodiments rather than to maintain strict structural accuracy, detail, and scale.

DESCRIPTION OF THE EMBODIMENTS

In the following description, reference is made to the chemical formulas that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Furthermore, to the extent that the terms "including", "includes", "having", "has", "with", or variants thereof are used in either the detailed description and the claims, such terms are intended to be inclusive in a manner similar to the term "comprising." The term "at least one of" is used to mean that one or more of the listed items can be selected.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

Figure 1:
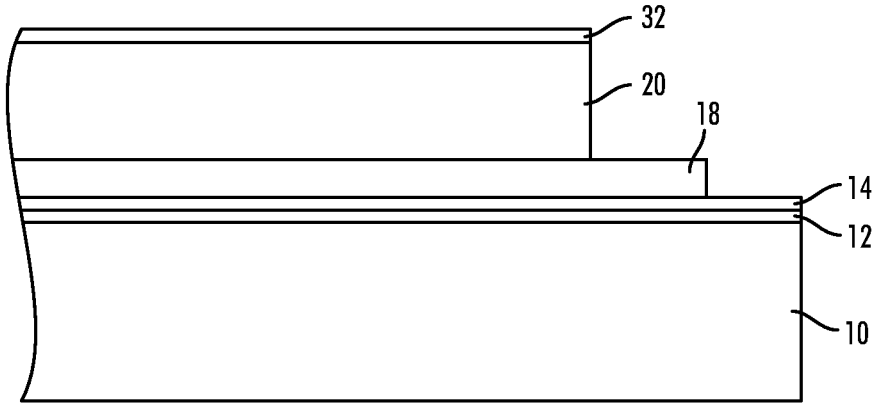
FIG. 1 is a cross-sectional view of an imaging member in a drum configuration according to the present embodiments.

FIG. 1 is an exemplary embodiment of a multilayered electrophotographic imaging member or photoreceptor having a drum configuration. The substrate may further be in a cylinder configuration. As can be seen, the exemplary imaging member includes a rigid support substrate 10, an electrically conductive ground plane 12, an undercoat layer 14, a charge generation layer 18 and a charge transport layer 20. An optional overcoat layer 32 disposed on the charge transport layer 20 may also be included. The substrate 10 may be comprised of a material selected from the group consisting of a metal, metal alloy, aluminum, zirconium, niobium, tantalum, vanadium, hafnium, titanium, nickel, stainless steel, chromium, tungsten, molybdenum, and mixtures thereof. The substrate 10 may also comprise a material selected from the group consisting of a metal, a polymer, a glass, a ceramic, and wood.

The charge generation layer 18 and the charge transport layer 20 form an imaging layer described here as two separate layers. It will be appreciated that the functional components of these layers may alternatively be combined into a single layer.

Figure 2:
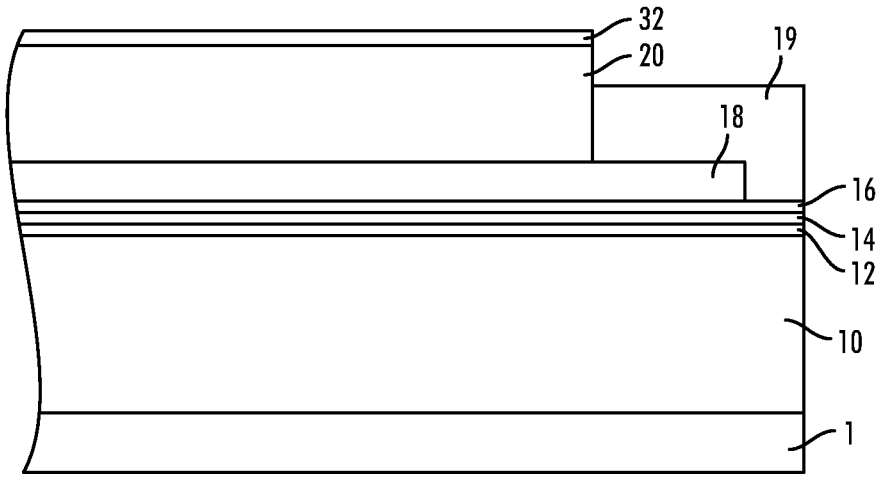
FIG. 2 is a cross-sectional view of an imaging member in a belt configuration according to the present embodiments.

FIG. 2 shows an imaging member or photoreceptor having a belt configuration according to embodiments. As shown, the belt configuration is provided with an anti-curl back coating 1, a supporting substrate 10, an electrically conductive ground plane 12, an undercoat layer 14, an adhesive layer 16, a charge generation layer 18, and a charge transport layer 20. An optional overcoat layer 32 and ground strip 19 may also be included. An exemplary photoreceptor having a belt configuration is disclosed in U.S. Pat. No. 5,069,993, which is hereby incorporated by reference in its entirety.

A standard process for producing a charge generation layer 18 involves milling photoreceptor (P/R) pigment using a roll mill or a paint shaker at the lab scale or a Dynomill at the production scale. Typical milling time may range from about 30 minutes to about 120 minutes in the paint shaker to several hours in the roll mill. In the particular case of hydroxy gallium phthalocyanine, roll mill milling time may need to be as long as several days. Additionally, both paint shaker and roll mill milling processes are known to be difficult to control and depend on a number of process parameters such as vessel volume and configuration, media type, size and loading etc. There is a need to introduce a more efficient milling process with fewer control parameters and significantly shorter milling time.

A current method for preparing a charge transport layer (CTL) containing polytetrafluoroethylene (PTFE) particles includes utilizing a high shear cavitation technique to mix the charge transport component and the PTFE. Typically, the mixture of all components undergoes three or more passes through a CaviPro Ultra High Shear processor (available from Five Star Technologies, Cleveland Ohio) narrow nozzle under high pressure. The severe conditions of a high shear processor may promote the desorption of dispersant, i.e., stabilizer, of the PTFE particle surface and produce less stable and less uniform dispersions. The particles in the resulting dispersions tend to aggregate. Although the current CaviPro processing is at its optimized state, there are many uncontrollable factors that can greatly affect the quality of dispersion. Furthermore, the CaviPro process is quite time consuming and greatly limits dispersion throughput. A reliable and less time intensive mixing process which produces uniform dispersion is desired.

Resonant acoustic mixing is distinct from conventional impeller agitation found in a planetary mixer or ultrasonic mixing. Low frequency, high-intensity acoustic energy is used to create a uniform shear field throughout the entire mixing vessel. The result is rapid fluidization (like a fluidized bed) and dispersion of material. In addition, resonant acoustic mixing is distinct from high shear cavitation mixing.

Resonant acoustic mixing differs from ultrasonic mixing in that the frequency of acoustic energy is orders of magnitude lower. As a result, the scale of mixing is larger. Unlike impeller agitation, which mixes by inducing bulk flow, the acoustic mixing occurs on a microscale throughout the mixing volume.

In acoustic mixing, acoustic energy is delivered to the components to be mixed. An oscillating mechanical driver creates motion in a mechanical system comprised of engineered plates, eccentric weights and springs. This energy is then acoustically transferred to the material to be mixed. The underlying technology principle is that the system operates at resonance. In this mode, there is a nearly complete exchange of energy between the mass elements and the elements in the mechanical system.

In a resonant acoustic mixing, the only element that absorbs energy (apart from some negligible friction losses) is the mix load itself. Thus, the resonant acoustic mixing provides a highly efficient way of transferring mechanical energy directly into the mixing materials. The resonant frequency can be from about 15 Hertz to about 2000 Hertz, or in embodiments from about 20 Hertz to about 1800 Hertz, or from about 20 Hertz to about 1700 Hertz. The resonant acoustic mixing is performed at an acceleration g force of from about 5 to about 100 G force.

Acoustic mixers rely on a low frequency and low shear resonating energy technology to maximize energy efficiency for mixing. The resonant acoustic mixers vigorously shake the dispersion with up to 100 G of force. The dispersion is mixed at a resonant frequency to maximize energy usage. The process utilizes high intensity, low shear vibrations which induces the natural separation of loosely aggregated particles while simultaneously mixing all regions of the dispersion. This technology is useful for high viscosity systems. Resonant acoustic mixers are available from Resodyn™ Acoustic Mixers.

Disclosed herein is a process for mixing a dispersion containing solid particles. The dispersion of solid particles and an organic solvent are combined. The dispersion has a particulate solid content of from about 0.5 weight percent to about 10 weight percent, or from about 1.5 weight percent to about 7 weight percent or from about 2 weight percent to about 5 weight percent. The dispersion is mixed at a resonant frequency of the mixing system.

The mixing process described herein can include the addition of the milling media to the dispersion of particles. Milling media can be selected from glass, zirconium oxide, steel including Teflon coated steel, tungsten carbide, plastics (polystyrene, polycarbonate, polyamide, acrylic), sand, zirconium toughened alumina (ZTA), silicon carbide, silicon nitride, Syalon™, Porox™, agate, flint pebbles, rare earth oxides such as ZrO and CeO, and the like, and mixtures thereof.

Charge Generation Layer

Disclosed herein is a new process for pigment milling of pigments for use in a charge generation layer using an acoustic mixer to improve milling efficiency, quality and time. The examples demonstrate successful P/R device preparation using Resodyn™ Acoustic Mixers with milling times as short as about 20 minutes to about 30 minutes and RSI index as low as 0.022. The P/R pigment is dispersed in a suitable binder and solvent solution and subjected to acoustic mixing. The mixing time with acoustic mixers is generally from about 5 minutes to about 60 minutes. The dispersion is coated and dried by any suitable technique.

Examples of charge generating pigments include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference.

Any suitable inactive resin materials may be employed as a binder in the charge generation layer 18, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation (Tokyo, Japan).

Any suitable solvent or solvent mixtures may be employed to form a coating solution for the solid pigment and binder dispersion. Solvents may include tetrahydrofuran, toluene, N-butyl acetate, xylene, monochlorbenzene, methylene chloride, cyclohexanone, methyl ethyl ketone, methyl isobutyl ketone, polyvinyl ketone and the like, and mixtures thereof.

The charge generating material can be present in the resinous binder composition in various amounts. Generally, at least about 5 percent by volume, or no more than about 90 percent by volume of the charge generating material is dispersed in at most about 95 percent by volume, or no less than about 10 percent by volume of the resinous binder, and more specifically at least about 20 percent, or no more than about 60 percent by volume of the charge generating material is dispersed in at most about 80 percent by volume, or no less than about 40 percent by volume of the resinous binder composition.

Any suitable and conventional technique may be utilized to apply the charge generation layer mixture to the supporting substrate layer. The charge generation layer may be formed in a single coating step or in multiple coating steps. Dip coating, ring coating, spray, gravure or any other drum coating methods may be used.

Drying of the deposited coating may be effected by any suitable conventional technique such as oven drying, infrared radiation drying, air drying and the like. The thickness of the charge generation layer is about 0.1 μm, or no more than about 5 μm, for example, from about 0.2 μm to about 3 μm or from about 0.25 μm to about 2.5 μm when dry. Higher binder content compositions generally employ thicker layers for charge generation.

Charge Transport Layer

Also disclosed herein is a two-step process which uses a Resodyn™ Acoustic Mixer (RAM) in combination of other dispersing method, such as sonication or CaviPro, for CTL dispersion preparation to achieve better uniformity and ultimately extend the P/R's life. The new process is more energy efficient, less time consuming, and easy to scale up. The improved dispersion quality and extended photoreceptor life have been demonstrated.

PTFE, (polytetrafluoroethylene), is an inert substance that when combined with the charge transport layer reduces the wear rate and greatly extends the life of a photoreceptor. The PTFE particle size and loading in CTL play important roles in the wear resistance of photoreceptors. In general, the higher of PTFE loading and the smaller the PTFE particles, the better the wear resistance. To achieve that, a uniform well dispersed PTFE-CTL dispersion is crucial towards its ability to decrease the wear rate of the resulting photoreceptor. However, current PTFE-CTL processing through the use of the CaviPro, though at its optimized state, cannot satisfactorily provide required uniform dispersions with small particles. The severe conditions of a high shear processor may promote the desorption of dispersant, i.e., stabilizer, and produce a less stable and uniform dispersion. Reducing PTFE loading can promote better dispersibility for better coatability; however, lower surface protection of the P/R is provided. In addition, since Cavipro process produces less stable dispersions, the consistency of the process is a concern for production, i.e., it accompanies less quality control.

A two-step procedure to prepare PTFE-CTL dispersions is described. In the first step, sonication or other method such as Cavipro, dynamilling, attritor milling, ball milling, etc., is used to disperse the solid particles of PTFE with necessary dispersant in solvent with or without other components, such as charge transport components and polymer binders. In the second step, a Resodyn™ Acoustic Mixer is used to well mix the dispersions from the first step or the mixture of the dispersion from the first step and the binder base solution that contains the rest of the components of the final formula.

The charge transport layer 20 may include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film forming polymeric material which is otherwise incapable of supporting the injection of photogenerated holes from the charge generation material and incapable of allowing the transport of these holes. This addition converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The high mobility charge transport component may comprise small molecules of an organic compound which cooperate to transport charge between molecules and ultimately to the surface of the charge transport layer, for example, but not limited to, N,N'-diphenyl-N,N-bis(3-methyl phenyl)-1,1'-biphenyl-4,4'-diamine (TPD), other arylamines like triphenyl amine, N,N,N',N'-tetra-p-tolyl-1,1'-biphenyl-4,4'-diamine (TM-TPD), and the like.

A number of charge transport compounds can be included in the charge transport layer, which layer generally is of a thickness of from about 5 to about 75 micrometers, and more specifically, of a thickness of from about 15 to about 40 micrometers. Examples of charge transport components are aryl amines of the following formulas/structures:

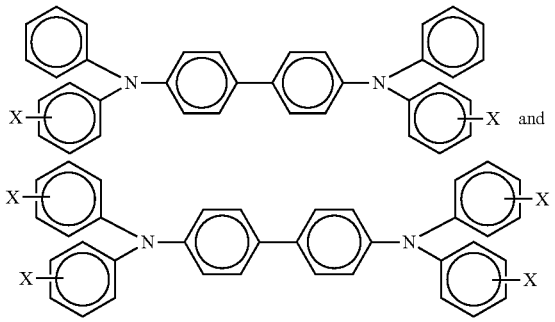

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

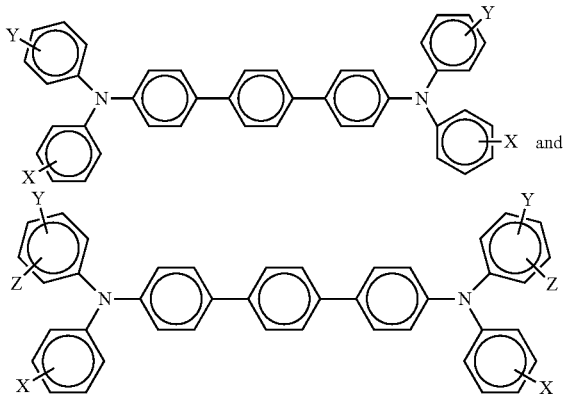

wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules may be selected in embodiments, for example, U.S. Pat. 4,921,773 and 4,464,450, the disclosures of which are totally incorporated herein by reference in their entirety.

Examples of the binder materials selected for the charge transport layers include components, such as those described in U.S. Pat. 3,121,006, the disclosure of which is totally incorporated herein by reference in its entirety. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments, the charge transport layer, such as a hole transport layer, may have a thickness of at least about 10 μm, or no more than about 40 μm.

Examples of components or materials optionally incorporated into the charge transport layers or at least one charge transport layer to, for example, enable improved lateral charge migration (LCM) resistance include hindered phenolic antioxidants such as tetrakis methylene(3,5-di-tert-butyl-4-hydroxy hydrocinnamate)methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layer is from about 0 to about 20, from about 1 to about 10, or from about 2 to about 8 weight percent.

Any suitable solvent or solvent mixtures may be employed to form a coating solution for the charge transport dispersion containing PTFE and binder. Solvents may include tetrahydrofuran, toluene, N-butyl acetate, xylene, monochlorbenzene, methylene chloride, cyclohexanone, and the like, and mixtures thereof.

The charge transport layer should be an insulator to the extent that the electrostatic charge placed on the hole transport layer is not conducted in the absence of illumination at a rate sufficient to prevent formation and retention of an electrostatic latent image thereon. The charge transport layer is substantially nonabsorbing to visible light or radiation in the region of intended use, but is electrically "active" in that it allows the injection of photogenerated holes from the photoconductive layer, that is the charge generation layer, and allows these holes to be transported through itself to selectively discharge a surface charge on the surface of the active layer.

In addition, in the present embodiments using a belt configuration, the charge transport layer may consist of a single pass charge transport layer or a dual pass charge transport layer (or dual layer charge transport layer) with the same or different transport molecule ratios. In these embodiments, the dual layer charge transport layer has a total thickness of from about 10 μm to about 40 μm. In other embodiments, each layer of the dual layer charge transport layer may have an individual thickness of from about 2 μtm to about 20 μm. Moreover, the charge transport layer may be configured such that it is used as a top layer of the photoreceptor to inhibit crystallization at the interface of the charge transport layer and the overcoat layer. In another embodiment, the charge transport layer may be configured such that it is used as a first pass charge transport layer to inhibit microcrystallization occurring at the interface between the first pass and second pass layers.

Any suitable and conventional technique may be utilized to apply the charge transport layer mixture to the supporting substrate layer. The charge transport layer may be formed in a single coating step or in multiple coating steps. Dip coating, ring coating, spray, gravure or any other drum coating methods or any belt or flat sheet coating methods may be used.

Drying of the deposited coating may be effected by any suitable conventional technique such as oven drying, infrared radiation drying, air drying and the like. The thickness of the charge transport layer after drying is from about 10 μm to about 40 μm or from about 12 μm to about 36 μm for optimum photoelectrical and mechanical results. In another embodiment the thickness is from about 14 μm to about 36 μm.

The Overcoat Layer

Other layers of the imaging member may include, for example, an optional over coat layer 32. An optional overcoat layer 32, if desired, may be disposed over the charge transport layer 20 to provide imaging member surface protection as well as improve resistance to abrasion. In embodiments, the overcoat layer 32 may have a thickness ranging from about 0.1 micrometer to about 25 micrometers or from about 1 micrometer to about 10 micrometers, or in a specific embodiment, about 3 micrometers to about 10 micrometers. These overcoat layers typically comprise a charge transport component and an optional organic polymer or inorganic polymer. These overcoat layers may include thermoplastic organic polymers or cross-linked polymers such as thermosetting resins, UV or e-beam cured resins, and the likes. The overcoat layers may further include a particulate additive such as metal oxides including aluminum oxide and silica, or low surface energy polytetrafluoroethylene (PTFE), and combinations thereof.

Any known or new overcoat materials may be included for the present embodiments. In embodiments, the overcoat layer may include a charge transport component or a cross-linked charge transport component. In particular embodiments, for example, the overcoat layer comprises a charge transport component comprised of a tertiary arylamine containing substituent capable of self cross-linking or reacting with the polymer resin to form a cured composition. Specific examples of charge transport component suitable for overcoat layer comprise the tertiary arylamine with a general formula of

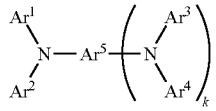

wherein $Ar^1$, $Ar^2$, $Ar^3$, and $Ar^4$ each independently represents an aryl group having about 6 to about 30 carbon atoms, $Ar^5$ represents aromatic hydrocarbon group having about 6 to about 30 carbon atoms, and k represents 0 or 1, and wherein at least one of $Ar^1$, $Ar^2$, $Ar^3$ $Ar^4$, and $Ar^5$ comprises a substituent selected from the group consisting of hydroxyl (—OH), a hydroxymethyl (—$CH_2OH$), an alkoxymethyl (—$CH_2OR$, wherein R is an alkyl having 1 to about 10 carbons), a hydroxylalkyl having 1 to about 10 carbons, and mixtures thereof. In other embodiments, $Ar^1$, $Ar^2$, $Ar^3$, and $Ar^4$ each independently represent a phenyl or a substituted phenyl group, and $Ar^5$ represents a biphenyl or a terphenyl group.

Additional examples of charge transport component which comprise a tertiary arylamine include the following:

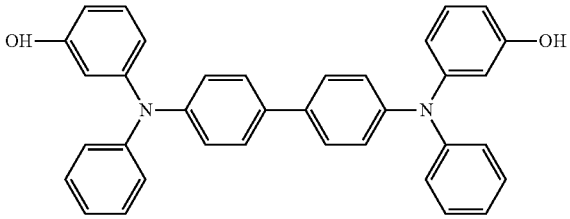

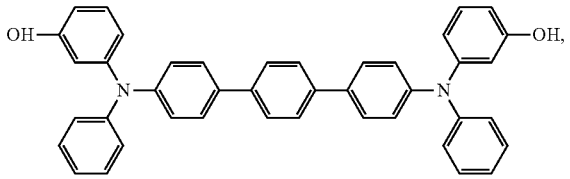

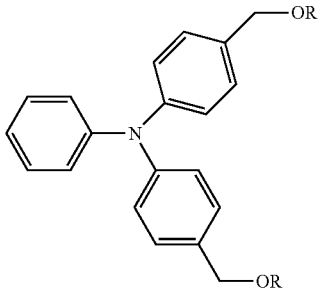

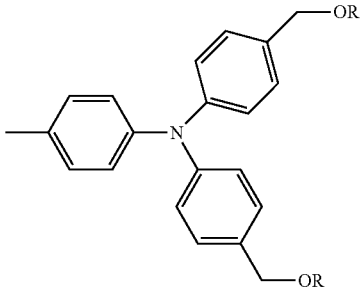

-continued

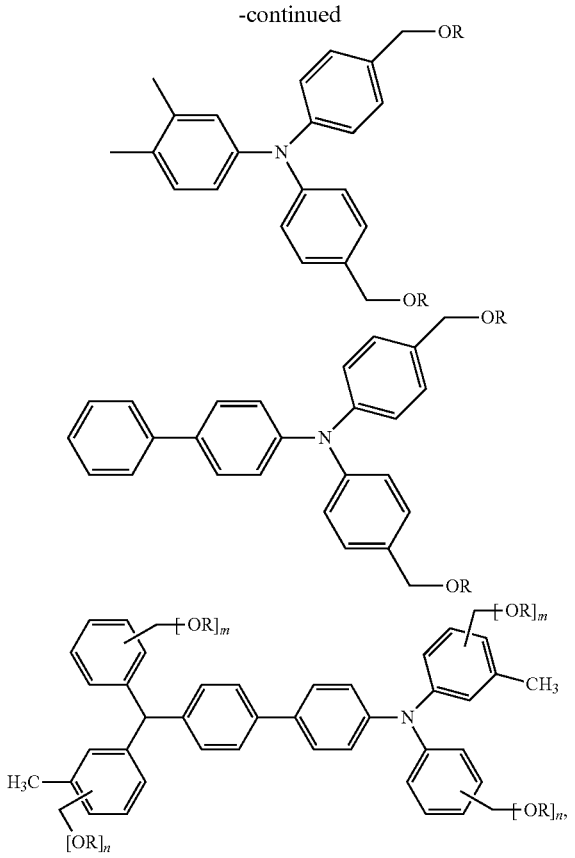

and the like, wherein R is a substituent selected from the group consisting of hydrogen atom, and an alkyl having from 1 to about 6 carbons, and m and n each independently represents 0 or 1, wherein m+n>1. In specific embodiments, the overcoat layer may include an additional curing agent to form a cured, crosslinked overcoat composition. Illustrative examples of the curing agent may be selected from the group consisting of a melamine-formaldehyde resin, a phenol resin, an isocyanate or a masking isocyanate compound, an acrylate resin, a polyol resin, or mixtures thereof. In embodiments, the crosslinked overcoat composition has an average modulus ranging from about 3 GPa to about 5 GPa, as measured by nano-indentation method using, for example, nanomechanical test instruments manufactured by Hysitron Inc. (Minneapolis, Minn.).

The Substrate

The photoreceptor support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed, such as for example, metal or metal alloy. Electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/ or oxides.

The substrate 10 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of many different configurations, such as for example, a plate, a cylinder, a drum, a scroll, an endless flexible belt, and the like. In the case of the substrate being in the form of a belt, as shown in FIG. 2, the belt can be seamed or seamless. In embodiments, the photoreceptor herein is in a drum configuration.

The thickness of the substrate 10 depends on numerous factors, including flexibility, mechanical performance, and economic considerations. The thickness of the support substrate 10 of the present embodiments may be at least about 500 micrometers, or no more than about 3,000 micrometers, or be at least about 750 micrometers, or no more than about 2500 micrometers.

An exemplary support substrate 10 is not soluble in any of the solvents used in each coating layer solution, is optically transparent or semi-transparent, and is thermally stable up to a high temperature of about 150° C. A support substrate 10 used for imaging member fabrication may have a thermal contraction coefficient ranging from about $1\times10^{-5}$ per ° C. to about $3\times10^{-5}$ per ° C. and a Young's Modulus of between about $5\times10^{-5}$ psi ($3.5\times10^{-4}$ Kg/cm$^2$) and about $7\times10^{-5}$ psi ($4.9\times10^{-4}$ Kg/cm$^2$).

The Ground Plane

The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be at least about 20 Angstroms, or no more than about 750 Angstroms, or at least about 50 Angstroms, or no more than about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 9000 Angstroms or a conductive carbon black dispersed in a polymeric binder as an opaque conductive layer.

The Hole Blocking Layer

After deposition of the electrically conductive ground plane layer, the hole blocking layer 14 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl)gamma-amino-propyl trimethoxy silane, isopropyl 4-aminobenzene sulfonyl, di(dodecylbenzene sulfonyl)titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl)methyl diethoxysilane, as disclosed in U.S. Pat. Nos. 4,338,387, 4,286,033 and 4,291,110.

General embodiments of the undercoat layer may comprise a metal oxide and a resin binder. The metal oxides that can be used with the embodiments herein include, but are not limited to, titanium oxide, zinc oxide, tin oxide, aluminum oxide, silicon oxide, zirconium oxide, indium oxide, molybdenum oxide, and mixtures thereof. Undercoat layer binder materials may include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like.

The hole blocking layer should be continuous and have a thickness of less than about 0.5 micrometer because greater thicknesses may lead to undesirably high residual voltage. A hole blocking layer of between about 0.005 micrometer and about 0.3 micrometer is used because charge neutralization after the exposure step is facilitated and optimum electrical performance is achieved. A thickness of between about 0.03 micrometers and about 0.06 micrometers is used for hole blocking layers for optimum electrical behavior. The hole blocking layers that contain metal oxides such as zinc oxide, titanium oxide, or tin oxide, may be thicker, for example, having a thickness up to about 25 micrometers. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

While embodiments have been illustrated with respect to one or more implementations, alterations and/or modifications can be made to the illustrated examples without departing from the spirit and scope of the appended claims. In addition, while a particular feature herein may have been disclosed with respect to only one of several implementations, such feature may be combined with one or more other features of the other implementations as may be desired and advantageous for any given or particular function.

EXAMPLES

Two samples of identical formulations were prepared by mixing pre-processed PTFE-polymer binder CTL dispersion which is composed of PTFE/mTBD/PCZ400/BHT in a weight ratio of 8/43/57/1 in THF/TOL (70/30) and CTL base solution composed of mTBD/PCZ400/BHT in a weight ratio of 43/57/1 in THF/TOL (70/30) in a 2:1 ratio. One sample was simply rolled in a ball mill overnight (referred to as Sample 2), while the other sample underwent further processing using a Resodyn™ LabRAM at 60 Hertz and 100 G force for 5 minutes (referred to as Sample 1). Samples 1 and 2 were coated on 30 mm by 404 mm drums and had same layer thicknesses of $TiO_2$ UCL and chlorogallium phthalocyanine CGL. The CTL was coated to a thickness of 24 microns using a Tsukiage coater.

Transmission electron micrographs (TEMs) showed significantly better uniformity in the CTL coated with dispersion processed with the RAM.

The electrical properties of photoreceptors coated with both dispersions were essentially identical. The electrical properties measured included depletion voltage ($V_{Depl}$), erase voltage ($V_{erase}$), voltage after 2.8 erg/cm$^2$ light exposure ($V_{2.8}$), dark decay, sensitivity (discharge slope of PIDC, dv/dx) and electrical thickness (DiThk) are summarized in Table 1.

TABLE 1

The electricals of photoreceptors with different PTFE-CTLs in B-zone and wear rates under stress test conditions.

| Sample | UCL/CGL | $V_{Depl}$ | DiThk | $V_{2.8}$ | dv/dx | $V_{erase}$ | dark decay | Wear rate (nm/kcycle) |
|---|---|---|---|---|---|---|---|---|
| 1 | UCCG#1 | 12 | 8.8 | 397 | −136 | 141 | 13 | 42 |
| 2 | UCCG#1 | 10 | 8.8 | 397 | −135 | 141 | 14 | 48 |
| 3 | UCCG#2 | 7 | 10.0 | 135 | −333 | 22 | 15 | 50 |
| 4 | UCCG#2 | 12 | 10.1 | 128 | −338 | 20 | 17 | 56 |

Samples 1 and 2 were tested under 1.45 KV;
Samples 3 and 4 were tested under 1.8 KV.
UCCG#1: 10um $TiO_2$UCL/chlorogallium phthalocyanine CGL;
UCCG#2: 1 um 3-component UCL/hydroxy gallium phthalocyanine CGL.

Figure 3:
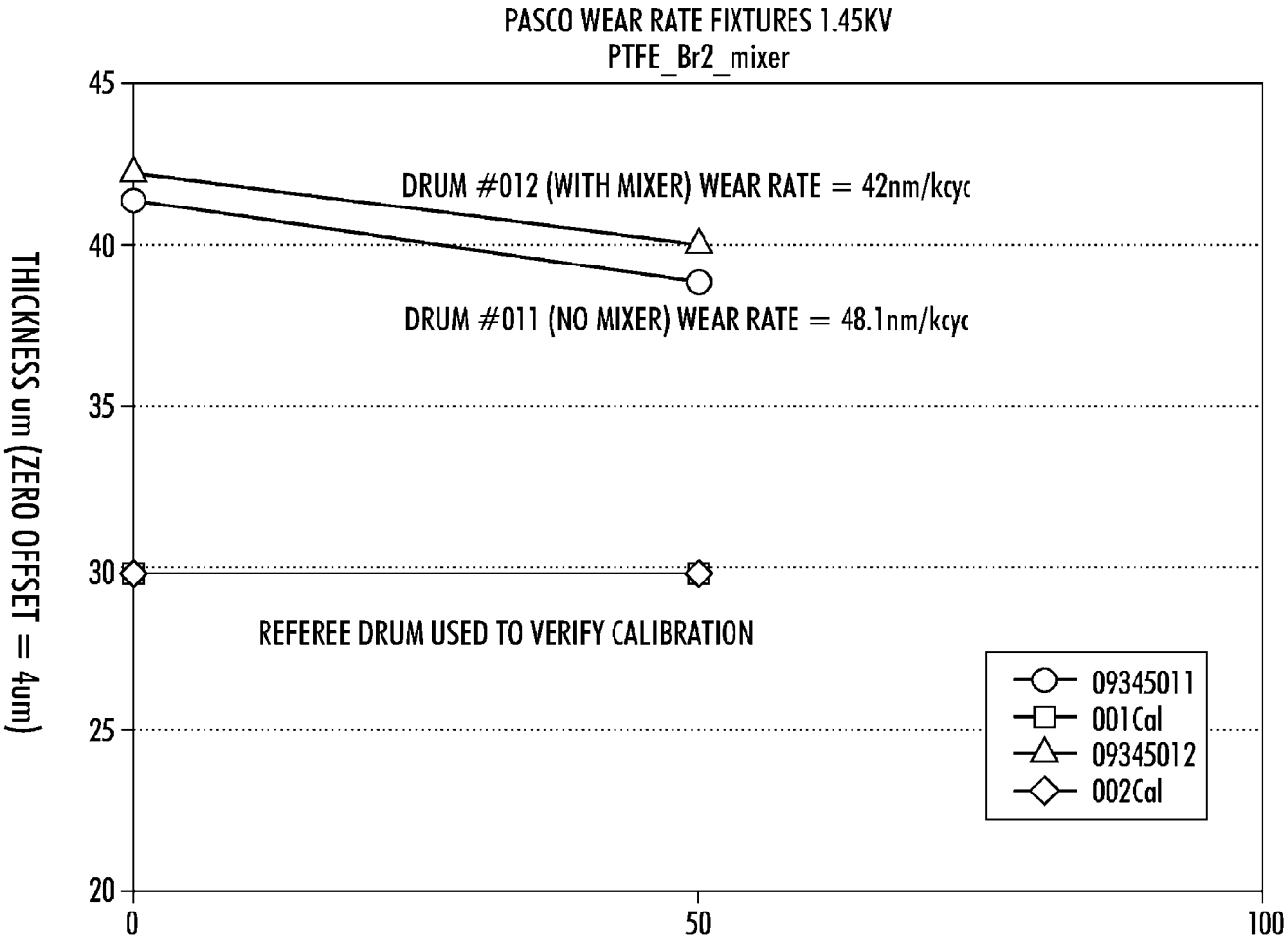
FIG. 3 shows the wear rates of photoreceptors with PTFE-charge transport layers prepared with and without an acoustic mixer.

The photoreceptor prepared with resonant acoustic mixing exhibited significant improvement in the wear rate of the PTFE-CTL layer over the wear rate of the PTFE-CTL that has no mixer processing. This is shown in FIG. 3.

The third CTL sample was prepared by pre-processing PTFE/GF400/TOL slurry which is composed of PTFE/GF400/TOL in a weight ratio of 8/0.24/7.8 by sonication and then mixed with a base solution composed of mTBD/PCZ400/BHT in a weight ratio of 43/57/1 in THF/TOL (70/30) and additional THF in a ratio of 16/419/18 by a Resodyn™ LabRAM mixer at 100 G acceleration for 8 minutes. The resulting dispersion (referred to as Sample 3) and the control dispersion (referred to as Sample 4) which had the same formulation but processed by Cavipro only were coated on 30 mm by 404 mm drums which had same layer thicknesses of 3-component UCL and CGL. The CTL was coated to a thickness of 29 microns using Tsukiage coater. The electrical properties of photoreceptors coated with both dispersions were also summarized in Table 1. They are essentially identical. The photoreceptor with the mixer-prepared CTL outperforms or at least equivalent to the photoreceptor with cavipro-only prepared CTL.

Additional experiments were performed for charge generation processing. For the control, pigment milling using paint shaker was conducted. In a 60 ml glass bottle, solid pigment comprising 55 weight percent hydroxyl gallium phthalocyanine and 45 weight percent vinyl chloride-vinyl acetate maleic acid terpolymer was loaded in n-butyl acetate at about 5 percent solids. 50 grams of 1 mm glass beads (available from Glen Mill Inc.) were added to the glass bottle. The 60 ml glass bottle was mixed using a paint shaker available from Red Devil Equipment Co. The glass beads were removed after processing by filtration or centrifugation.

Pigment milling using a Resodyn™ Acoustic mixer was conducted. In a 60m1 glass bottle, solid pigment comprising 55 weight percent hydroxyl gallium phthalocyanine and 45 weight percent vinyl chloride-vinyl acetate maleic acid terpolymer was loaded in n-butyl acetate at about 5 percent solids. 50 grams of 1 mm glass beads (available from Glen Mill Inc.) were added to the glass bottle. The 60 ml glass bottle was mixed at a resonant frequency using the Resodyn™ Acoustic mixer at the following settings: 80 G acceleration, 60.9 Hz resonance frequency. The glass beads were removed after processing by filtration or centrifugation.

Figure 4:
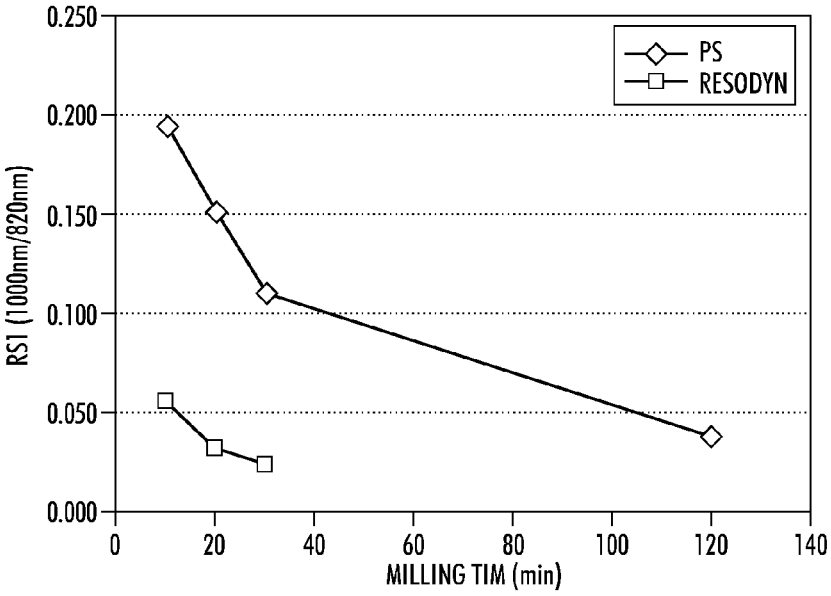
FIG. 4 shows the relative scattering index (RSI) of dispersion at different milling time by different milling methods.

The graph in FIG. 4 shows RSI (absorbance @ 1000 nm/820 nm) evolution with milling time in the paint shaker and Resodyn™ Acoustic mixer. The Resodyn™ Acoustic mixer produces much lower RSI (relative scattering index) values at the same milling time compared to the paint shaker. RSI is calculated with the following equation: RSI=(absorbance of charge generator (CG) at 1000 nm)/(absorbance of CG at 820 nm). It measures the quality of the CG solution and RSI values less that 0.1 are desired. FIG. 4 clearly shows a marked improvement in RSI values when using the Resodyn™ acoustic mixer.

The absorption spectra of pigment milled in Resodyn™ acoustic mixer and control pigment milled in a paint shaker showed similar absorbance versus time characteristics.

Evaluation devices were prepared by coating the following dispersion on a aluminized mylar overacted aluminum substrate: 55 weight percent hydroxy gallium phthalocyanine and 45 weight percent vinyl chloride-vinyl acetate maleic acid terpolymer in n-butyl acetate,. CTL: 40% m-TBD: 60% PC(Z)400

Figure 5:
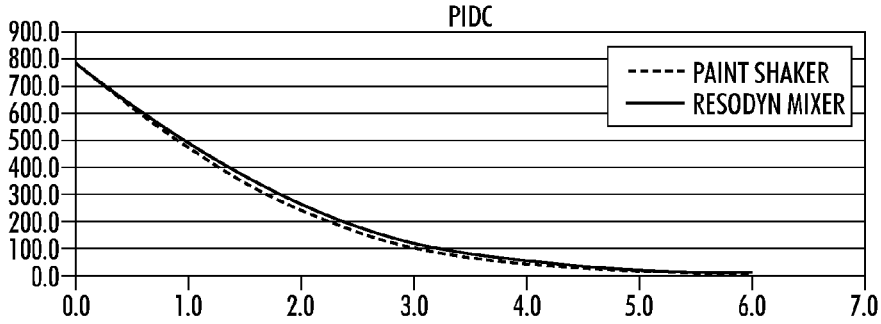
FIG. 5 shows a PIDC (photo induced discharge curve) of two devices prepared using paint shaker and an acoustic mixer in pigment blending for 30 minutes.

FIG. 5 shows the PIDC (photo induced discharge curve) of two devices prepared using paint shaker and Resodyn mixer for pigment blending for 30 minutes. Table 2 shows electrical properties of the devices prepared using the paint shaker and Resodyn™ acoustic mixer. The electrical properties measured included dark decay, sensitivity (discharge slope of PIDC, dv/dx), the exposure required to reduce the surface potential to half ($E_{1/2}$) in ergs/cm$^2$, the exposure required to reduce the surface potential by ⅞ ($E_{7/8}$) in ergs/cm$^2$ and residual voltage just after erase ($V_r$), are summarized in Table 2. All the electrical properties from the Resodyn™ Acoustic mixer sample are similar to the control.

TABLE 2

| Sample | Dark Decay (500 ms) (V) | S | $E_{1/2}$ (ergs/cm$^2$) | $E_{7/8}$ (ergs/cm$^2$) | $V_r$ |
|---|---|---|---|---|---|
| 30' on Paint Shaker | 17 | 340 | 1.30 | 3.10 | 5 |
| 30' on Resodyn Mixer | 16 | 326 | 1.35 | 3.27 | 4 |

It will be appreciated that variants of the above-disclosed and other features and functions or alternatives thereof, may be combined into other different systems or applications. Various presently unforeseen or unanticipated alternatives, modifications, variations, or improvements therein may be subsequently made by those skilled the in the art which are also encompassed by the following claims.

What is claimed is:

1. A process comprising:

obtaining a dispersion of solid particles and an organic solvent wherein the dispersion comprises a particulate solid content of from about 0.5 weight percent to about 10 weight percent; and mixing the dispersion on a mixer that applies high intensity acoustic energy at a resonant frequency of a mixing system containing the dispersion.

2. The process according to claim 1, wherein the solid particles comprise a pigment selected from the group consisting of amorphous selenium, trigonal selenium, selenium alloys, phthalocyanine pigments, metal phthalocyanines, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and mixtures thereof.

3. The process according to claim 2, wherein dispersion comprises a relative scattering index of less than about 0.1.

4. The process according to claim 1, wherein the solid particles comprise polytetrafluoroethylene.

5. The process according to claim 4, wherein the dispersion further comprises charge transport components.

6. The process according to claim 1, wherein the solvent is selected from the group consisting of tetrahydrofuran, toluene, N-butyl acetate, xylene, monochlorbenzene, methylene chloride, cyclohexanone, methyl ethyl ketone, methyl isobutyl ketone, polyvinyl ketone and mixtures thereof.

7. The process according to claim 1, wherein acoustic mixing is conducted for a time of about 5 minutes to about 60 minutes.

8. The process according to claim 1, wherein the dispersion further comprises milling media selected from the group consisting of glass, zirconium oxide, steel, tungsten carbide, plastics, sand, zirconium toughened alumina, silicon carbide, silicon nitride, agate, flint pebbles, rare earth oxides, and mixtures thereof.

9. A process of forming a charge generation layer comprising:

mixing a dispersion of solid pigment particles, a binder and an organic solvent wherein the dispersion comprises a particulate solid content of from about 0.5 weight percent to about 10 weight percent;

subjecting the dispersion to acoustic mixing at a resonant frequency of a mixing system containing the dispersion;

coating the dispersion on a conductive substrate; and removing the solvent to form a charge generation layer.

10. The process according to claim 9, wherein the solid pigment particles are selected from the group consisting of amorphous selenium, trigonal selenium, selenium alloys, phthalocyanine pigments, metal phthalocyanines, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and mixtures thereof.

11. The process according to claim 9, wherein the dispersion further comprises milling media selected from the group consisting of glass, zirconium oxide, steel, tungsten carbide, plastics, sand, zirconium toughened alumina, silicon carbide, silicon nitride, agate, flint pebbles, rare earth oxides, and mixtures thereof; and removing the milling media prior to coating.

12. The process according to claim 9, wherein the solvent is selected from the group consisting of tetrahydrofuran, toluene, N-butyl acetate, xylene, monochlorbenzene, methylene chloride, cyclohexanone, methyl ethyl ketone, methyl isobutyl ketone, polyvinyl ketone and mixtures thereof.

13. The process according to claim 9, wherein the binder is selected from the group consisting of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and poly(4,4'-dihydroxy-diphenyl-1-1-cyclohexane.

14. The process according to claim 9, wherein the particles of the charge generation layer comprises a relative scattering index of less than about 0.1.

15. A process of forming a charge transport layer comprising:

mixing a dispersion of polytetrafluoroethylene, a binder and an organic solvent wherein the dispersion comprises a particulate solid content of from about 0.5 weight percent to about 10 weight percent;

subjecting the dispersion to acoustic mixing at a resonant frequency of a mixing system containing the dispersion thereby producing a relative scattering index of less than about 0.1 in the dispersion;

coating the dispersion on a conductive substrate; and removing the solvent to form a charge transport layer.

16. The process according to claim 15, wherein the resonant frequency is from about 15 Hertz to about 2000 Hertz.

17. The process according to claim 15, wherein the solvent is selected from the group consisting of tetrahydrofuran, toluene, N-butyl acetate, xylene, monochlorbenzene, methylene chloride, cyclohexanone, and the like, and mixtures thereof.

18. The process according to claim 15, wherein the dispersion further comprises charge transport components.

19. The process according to claim 15, wherein the binder is selected from the group consisting polycarbonates, polyarylates, acrylate polymers, vinyl polymers, cellulose polymers, polyesters, polysiloxanes, polyamides, polyurethanes, poly(cyclo olefins), epoxies and mixtures thereof.

20. The process according to claim 15, further comprising mixing the at least one charge transport component and solvent prior to mixing the dispersion.

* * * * *